US005366064A

United States Patent [19]

Gamberini et al.

[11] Patent Number: 5,366,064

[45] Date of Patent: Nov. 22, 1994

[54] PRODUCT MANUFACTURING METHOD, PARTICULARLY FOR TOBACCO ITEMS

[75] Inventors: Antonio Gamberini, Bologna; Fabio Sassi, Imola; Antonio Gigante, Bologna, all of Italy

[73] Assignee: G. D. Societa'Per Azioni, Bologna, Italy

[21] Appl. No.: 168,872

[22] Filed: Dec. 16, 1993

[30] Foreign Application Priority Data

Dec. 18, 1992 [IT] Italy ..... B092A000440

[51] Int. Cl.[5] ..... B65G 47/26

[52] U.S. Cl. ..... 198/426; 198/418.7; 198/434; 198/471.1

[58] Field of Search ..... 198/434, 459, 426, 418.7, 198/471.1, 347.3

[56] References Cited

U.S. PATENT DOCUMENTS

| | | | |
|---|---|---|---|
| 3,158,251 | 11/1964 | Skala et al. | 198/434 |
| 3,601,242 | 8/1971 | Reinemuth | 198/459 |
| 3,957,152 | 5/1976 | Heitmann | 198/471.1 X |
| 4,547,645 | 10/1985 | Smith et al. | 198/459 X |
| 4,830,170 | 5/1989 | Folke | 198/347.3 |

FOREIGN PATENT DOCUMENTS

| | | |
|---|---|---|
| 1569323 | 5/1969 | France . |
| 3120674 | 12/1982 | Germany . |
| 3319390 | 1/1985 | Germany . |
| 3705941 | 8/1988 | Germany . |

*Primary Examiner*—James R. Bidwell
*Attorney, Agent, or Firm*—Ladas & Parry

[57] ABSTRACT

A method of manufacturing products, particularly tobacco items, on a production line wherein at least a first product manufacturing machine and at least a second product grouping machine, for forming the products into groups containing a given number of products, are connected rigidly and in time with each other by way of a transfer device; the method comprising stages wherein, by way of the transfer device, a first orderly succession of products from the first machine and containing vacancies is manipulated and converted into a second succession for supply to the second machine and containing a succession of gaps and full portions, wherein each gap and each full portion is composed of a number of products which is a multiple of the number of products in each group, and is in time with the second machine.

8 Claims, 5 Drawing Sheets

Fig.3
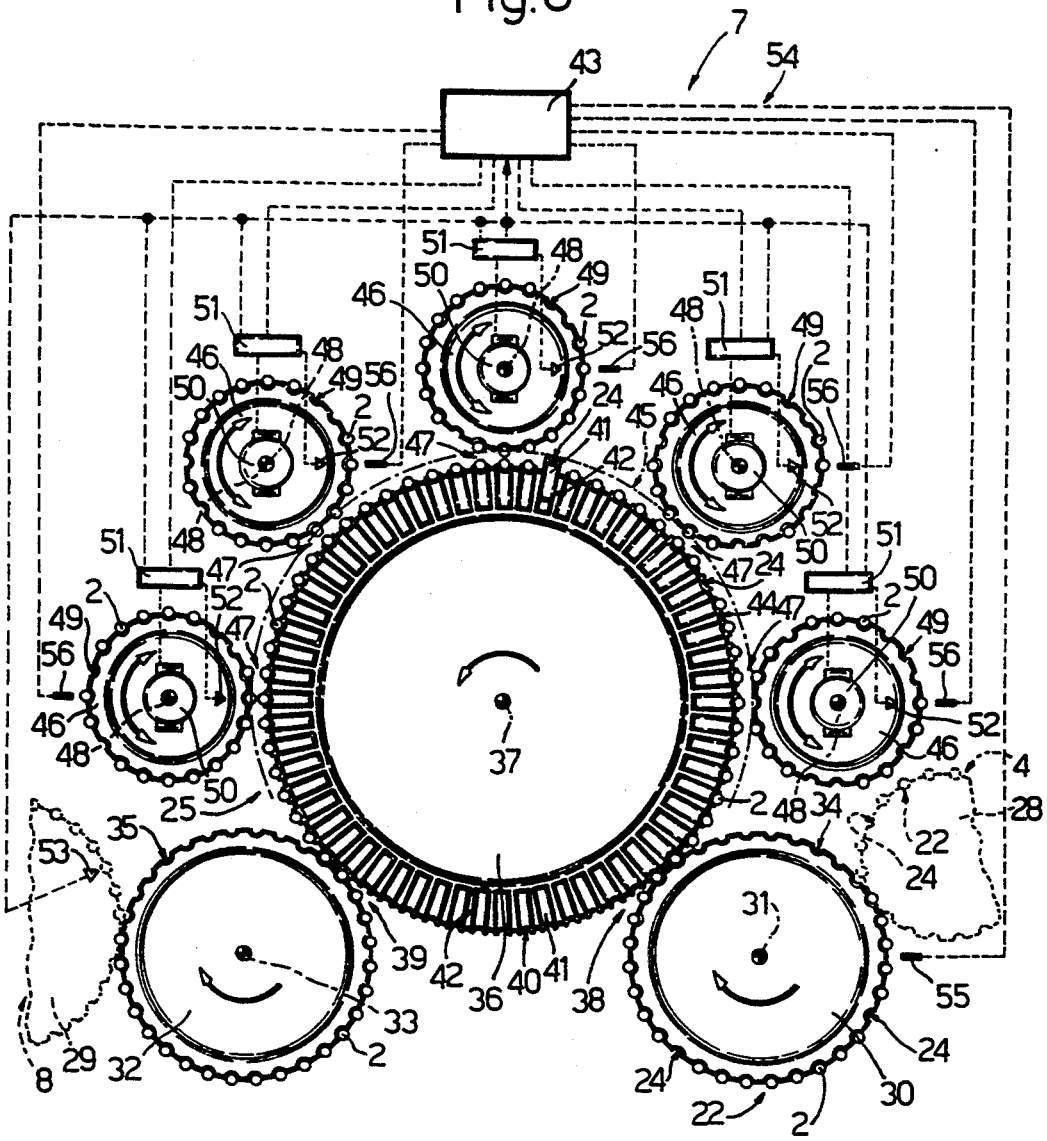
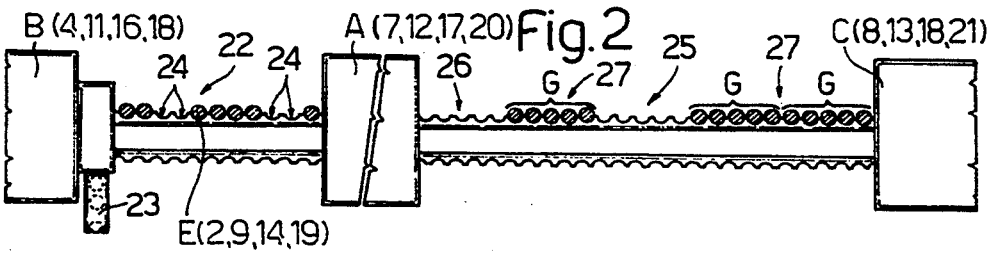
Fig.2

PRODUCT MANUFACTURING METHOD, PARTICULARLY FOR TOBACCO ITEMS

BACKGROUND OF THE INVENTION

The present invention relates to a product manufacturing method, particularly for tobacco items.

In the following description, specific reference is made, purely by way of example, to a method of producing and processing cigarettes.

In general, cigarettes are produced and processed on a production line comprising a number of individual machines arranged in series, and each of which provides for a specific processing function, and is so operated as to accommodate the cigarette supply from the adjacent upstream machine.

In its most general form, such a line comprises a machine for producing cigarette portions; a filter assembly machine for producing filter-tipped cigarettes; a packing machine for forming groups of filter-tipped cigarettes into packets; a cellophaning machine for overwrapping each packet with a sheet of transparent material; a cartoning machine for grouping and forming the packets into cartons; a wrapping machine for overwrapping each carton; a boxing machine for grouping and loading the cartons into boxes; and a pallet loading machine for grouping and loading the boxed cartons on to a pallet.

Clearly, therefore, such a line comprises a number of handling machines, such as the filter assembly, cellophaning and wrapping machines, each of which provides for a specific handling operation of the incoming products from the adjacent upstream machine; and a number of grouping machines, each of which provides for forming the incoming products from the adjacent upstream machine into groups of a given number of products.

On such a line, each handling machine is normally operated "in time" with the adjacent upstream machine, i.e. the machine preceding it in the traveling direction of the cigarettes, and is connected to the upstream machine by a "rigid" type transfer device, at times with a compensating store.

Each grouping machine, on the other hand, is connected to the adjacent upstream machine by a respective transfer device which normally provides, between the machines, for a "flexible" type connection featuring either a product reintegrating or compensating store. In this case, the two machines do not operate in time with each other, and the products are fed in disorderly manner between the upstream and downstream machines, and are received in orderly manner by the downstream machine. In other words, with a flexible connection of the type still widely used for feeding products to a grouping machine, the products are fed in orderly manner off the upstream machine, and are subsequently disordered, only to be re-ordered for supply to the downstream machine.

The above operating mode is described, for example, in Patent DE-OS 31 20 674, in which the cigarettes coming off the manufacturing machine are fed in bulk to a feedbox with a number of output channels, each designed to feed a respective seat on an ordering drum by which the cigarettes are formed into a complete orderly sequence for supply to a follow-up packing machine.

A similar operating mode obviously involves a considerable waste of energy as well as a number of drawbacks mainly due to the sequence of handling operations to which the products are subjected.

One proposal for overcoming the above drawbacks has been to connect the grouping machine to the adjacent upstream machine by means of a rigid connection featuring a reintegrating device. In this case, the two machines are permanently synchronized with each other, and the products coming off the upstream machine are transferred synchronously to the downstream machine in the same orderly configuration in which they were fed off the upstream machine. As both machines are connected synchronously, the reintegrating device provides for supplying products with which to fill one or more gaps or one or more vacancies occurring at the output of the upstream machine. Here and hereinafter, the terms "vacancy" and "gap" are intended to mean the space formed on the connecting line between the two machines by the absence of one or a number of consecutive products respectively, which gaps and/or vacancies would, in the absence of reintegration, result in a shortage of one or more units in the product group formed on the downstream machine, and consequently in rejection of the incomplete group.

The above operating mode is described, for example, in Patents DE-PS 33 19 390 and DE-OS 37 05 941, in which the cigarettes coming off the manufacturing machine are fed to the packing machine by means of an intermediate feed device which receives a discontinuous sequence of cigarettes, and feeds them along an internal path which gets one step shorter for each vacancy in the discontinuous sequence, so as to convert the discontinuous sequence into a continuous one for supply to the packing machine. When the number of compensated vacancies equals the number of cigarettes in the packet formed on the packing machine, the original length of the internal path is restored, so as to feed to the packing machine a sequence containing a gap consisting of a succession of vacancies equal to the number of cigarettes in each packet. Upon the gap arriving at the input of the packing machine, this provides for performing a no-load cycle.

A similar operating mode presents numerous drawbacks, mainly due to the fact that the location of the gap in the sequence supplied to the packing machine, or more generally the downstream grouping machine, depends on the manner—purely random in general—in which the vacancies are presented.

One consequence of the above is that the grouping machine must be capable of performing a no-load cycle as of any point within the normal machine cycle. Apart from the fact that such a grouping machine in general, and a packing machine in particular, is still unheard of, even if it were to exist, it would fail to provide for entirely eliminating rejects, and would almost invariably result in the rejection of two incomplete groups upon arrival of each said gap. In fact, on almost all known grouping machines, the groups are formed, not continuously, but by first forming subgroups, and only in the event the start of said gap coincides with the start of one of the subgroups would it, perhaps, be possible to avoid said two rejects.

SUMMARY OF THE INVENTION

It is an object of the present invention to provide a method designed to overcome the aforementioned drawbacks.

In particular, it is an object of the present invention to provide a method enabling rigid connection of a known handling machine to a known grouping machine, in such a manner as to eliminate rejects, and with no substantial alterations required to the machines themselves.

According to the present invention, there is provided a method of manufacturing products, particularly tobacco items, on a production line, particularly a line for producing and processing cigarettes; the line comprising at least a first product manufacturing machine, and at least a second product grouping machine; and the method comprising stages wherein, by means of said first machine, a first succession is formed possibly presenting randomly distributed vacancies, each defined by at least one missing said product; and, via transfer means for connecting said two machines rigidly and in time with each other, said first succession is fed to said second machine for forming the products into groups, each comprising a given number of products; characterized by the fact that it comprises a further stage wherein, via said transfer means, said first succession is manipulated and converted into a second succession for supply to said second machine and comprising a succession of gaps and full portions, in which each said gap and each said full portions, is composed of a number of products which is a multiple of said given number and in time with said second machine.

According to a first preferred embodiment of the above method, the first succession is manipulated by the addition of integrating products with which to fill all said vacancies.

Said integrating products are preferably withdrawn from storage means; and at least some of said gaps are formed for reloading the storage means.

According to a second preferred embodiment of the above method, the first succession is manipulated by varying the length of the path along which the first succession travels through said transfer means, so as to eliminate said vacancies.

Finally, according to a third preferred embodiment of the above method, the first succession is manipulated by removing products from the first succession, so as to replace said vacancies with a succession of said gaps in time with said second machine.

BRIEF DESCRIPTION OF THE DRAWINGS

A number of preferred embodiments of the present invention will be described by way of example with reference to the accompanying schematic drawings, in which:

FIG. 2 shows a schematic side view, partly in blocks, of a detail in FIG. 1;

FIG. 3 shows a schematic side view, partly in blocks and with parts removed for clarity, of a first embodiment of a detail in FIG. 2;

DETAILED DESCRIPTION OF THE INVENTION

Figure 1:
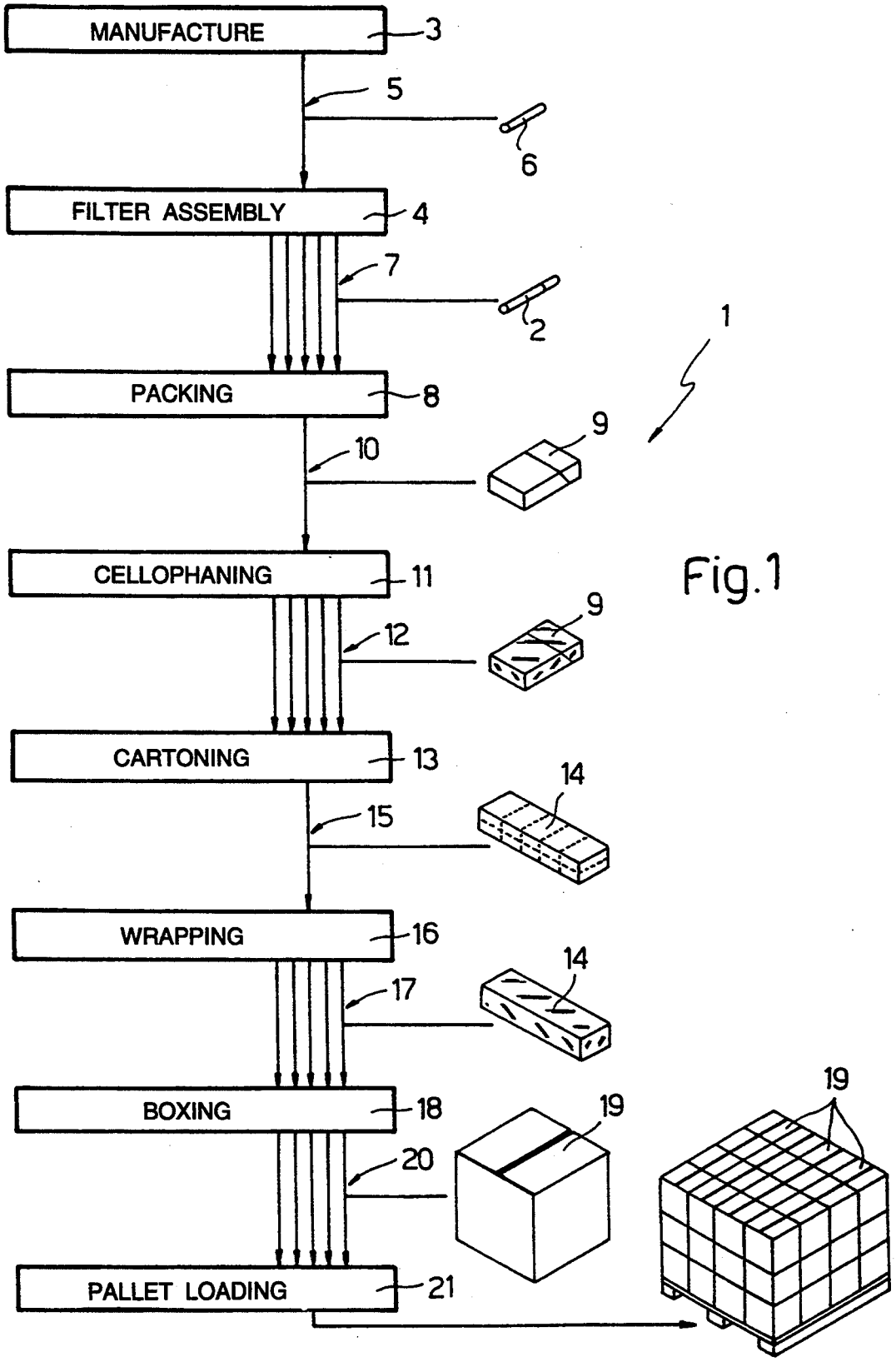
FIG. 1 shows a block diagram of a cigarette manufacturing and processing line implementing the method according to the present invention.

Number 1 in FIG. 1 indicates a line for producing and processing cigarettes 2.

Line 1 comprises, in succession, a manufacturing machine 3, the output of which is connected to the input of a filter assembly machine 4 by a known, normally rigid type transfer device 5 for supplying machine 4 with an orderly succession of cigarette portions 6. The output of machine 4 is connected by a transfer device 7 to the input of a packing machine 8 for receiving cigarettes 2 from machine 4 and forming them into groups inside respective packets 9 which are transferred by a known, rigid transfer device 10 to a cellophaning machine 11. The packets 9 from machine 11 are fed by a transfer device 12 to the input of a cartoning machine 13 for forming groups of normally ten packets into cartons 14, which are transferred by a known, rigid transfer device 15 to a wrapping machine 16. The cartons 14 from machine 16 are fed by a transfer device 17 to the input of a boxing machine 18 for forming groups of normally at least twenty cartons into boxes 19, which are transferred by a transfer device 20 to a pallet loading machine 21.

With reference to FIG. 2, each device 7, 12, 17, 20 is a transfer device, indicated generally by A, supplied at the input, by a handling machine 4, 11, 16, 18, indicated generally by B, with a succession 22 of products 2, 9, 14, 19, indicated generally by E, in which a known reject device 23 has formed randomly distributed vacancies 24 which may or may not be adjacent to one or more other vacancies 24. Device A also provides for supplying a downstream machine, consisting of a grouping machine 8, 13, 18, 21 indicated generally by C and by which products E are formed into groups G of a given number of products (in FIG. 2, equal to five, by way of example), with a succession 25 of products E consisting of a succession of gaps 26 and full portions 27, in which each gap 26 and each full portion 27 is composed of an uninterrupted sequence of missing and present products E respectively, and in which each said sequence is composed of a number of products E which is a multiple of said given number and in time with machine C.

As devices 7, 12, 17 and 20 operate according to the same principle, the following description will be limited by way of example to only one of said devices, in particular, transfer device 7 between filter assembly machine 4 and packing machine 8.

With reference to FIG. 3, device 7 is interposed between an output roller 28 of filter assembly machine 4 and an input roller 29 of packing machine 8, and comprises an input roller 30 tangent to roller 28 and rotating clockwise (in FIG. 3) about an axis 31 perpendicular to the FIG. 3 plane; and an output roller 32 tangent to roller 29 and rotating clockwise (in FIG. 3) about an axis 33 parallel to axis 31.

Rollers 30 and 32 present respective numbers of peripheral suction seats 34 and 35 parallel to axes 31 and 33 and equally spaced about the periphery of rollers 30 and 32 for retaining respective cigarettes 2 by suction.

Device 7 also comprises a powered drum 36 rotating anticlockwise (in FIG. 3) about an axis 37 parallel to axes 31 and 33, and which is tangent to roller 30 at a loading station 38 where it is supplied with a discontinuous succession 22 of cigarettes 2 by roller 30. Drum 36 is also tangent to roller 32 at an unloading station 39 where drum 36 supplies roller 32 with a succession 25 of cigarettes 2, which is either continuous or at most presents predeermined gaps 26 (FIG. 2) formed by the absence of "n" number of cigarettes 2, equal to the content of packet 9, or a whole multiple of said number.

Drum 36 comprises a number of equally spaced peripheral seats 40 for receiving and retaining by suction respective cigarettes 2 supplied by roller 30. More specifically, seats 40 are movable and each formed on a respective slide 41 consisting, in known manner, of the piston of a respective pneumatic cylinder 42 positioned radially along a peripheral annular portion of drum 36. Slides 41 are movable radially in relation to drum 36 by a known pneumatic distributor (not shown) formed inside drum 36 and controlled by a central unit 43. Unit 43 provides for selectively supplying compressed air to cylinders 42 so as to move respective slides 41 radially between a withdrawn position, wherein respective seats 40 are arranged, with the same spacing as seats 34, about the outer peripheral surface 44 of drum 36, and an extracted position wherein respective seats 40 are equally spaced about a cylindrical surface 45 coaxial with axis 37 and larger in diameter than drum 36.

Again with reference to FIG. 3, device 7 comprises a series of five identical reitegrating rollers 46 located between stations 38 and 39, tangent to cylindrical surface 45, and each defining a dynamic reintegrating store for receiving a given number of cigarettes 2 (in this case, equal to said "n" number of cigarettes 2 in each packet 9), and for exchanging cigarettes 2 one way or the other with drum 36 at a respective exchange station 47. More specifically, each roller 46 rotates both ways about a respective axis 48 parallel to axes 31, 33 and 37, and presents a number of suction seats 49 for retaining respective cigarettes 2 by suction, and equally spaced about the outer periphery of roller 46 with the same spacing as seats 40 at surface 45. Each roller 46 rotates in time with successions 22 and 25 and at a surface speed equal to that of drum 36 at surface 45; is driven by a respective independent motor 50; and is feedback-controlled as to angular position and speed by a respective known control system 51 connected to a first sensor 52 for detecting the angular position of respective roller 46, and to a second sensor 53 for detecting the angular position of roller 29 and the phase of machine 8. Control systems 51 are also connected to one another and to central unit 43 which, together with control systems 51, sensors 52 and sensor 53, forms part of a device 54 for controlling and synchronizing rollers 46 and cylinders 42 as a function of a signal supplied to central unit 43 by a further sensor 55 for detecting and communicating to central unit 43 the presence/absence of cigarettes 2 on roller 30. The presence/absence of cigarettes 2 on each roller 46, on the other hand, is communicated to central unit 43 by a respective sensor 56 positioned facing respective roller 46.

Operation of device 7 will now be described as of an intermediate operating condition wherein rollers 46 retain a variable number of cigarettes 2 inside respective seats 49, and succession 22 of cigarettes 2 supplied to roller 30 presents randomly distributed vacancies 24.

As they are transferred to roller 30, the cigarettes 2 in succession 22 are counted by sensor 55 in time with machine 8, for which purpose, the cigarettes 2 fed on to roller 30 are counted by sensor 55 as a succession of groups G (FIG. 2), each of which is to form a respective packet 9 on machine 8, and each of which is housed inside a continuous succession of "n" seats 34. In other words, if the cigarettes 2 in each group F are, say, twenty, sensor 55 counts seats 34 cyclically from one to twenty, and the start of the first numbering cycle is controlled by the phase signal from sensor 53.

In each group G, the number and location of any vacancies 24 are determined, and the corresponding information supplied by sensor 55 to central unit 43.

Obviously, no action is taken by control device 54 in the event of the passage of a complete group corresponding to a packet 9. Conversely, in the event sensor 55 detects, say, one vacancy 24 in the group, central unit 43 is activated and determines whether a roller 46 exists which, rotating as stated in time with drum 36, is capable of feeding a cigarette—hereinafter referred to as the "corresponding cigarette"—to respective station 47 simultaneously with the passage through station 47 of said vacancy 24. In the event of a positive response, unit 43 selects said roller 46 and, before the detected vacancy 24 reaches said station 47, activates respective cylinder 42 so as to move respective slide 41 into the extracted position, i.e. into such a position as to enable it to receive said cigarette 2 in known manner as it passes through said station 47. At this point, slide 41 is withdrawn, and cigarettes 2 are fed towards station 39 along a path extending about surface 44.

If, on the other hand, none of rollers 46 presents a cigarette corresponding to said vacancy 24, whereas rollers 46 present cigarettes 2 in other angular positions, unit 43 selects one of rollers 46 according to a given logic, and instructs respective control system 51 to so operate respective motor 50 as to accelerate or decelerate the selected roller 46 and so gain or lose the number of steps required for feeding a cigarette 2 into the position corresponding to vacancy 24. At this point, upon completion of the transient phase of the selected roller 46, i.e. upon the selected roller 46 again operating in time with drum 36, cigarette 2 is exchanged as already described.

Whenever a cigarette 2 is transferred from a roller 46 to drum 36, central unit 43 determines the number of cigarettes 2 left on rollers 46, and, upon any one of rollers 46 being found empty, provides for reloading it by moving all the "n" slides 41 of a given group into the extracted position prior to reaching station 47 of the empty roller 46, and by transferring on to roller 46 all the cigarettes 2 inside seats 40 of said group of slides 41, so as to form a gap 26 (FIG. 2) on drum 36. The groups transferred from drum 36 to each of rollers 46 are preferably selected by central unit 43 from among those presenting one or more vacancies 24.

In the event a succession of seats 40 in a given group on drum 36 presents a relatively large number of vacancies 24, unit 43 may provide for reintegrating at least some of rollers 46, even if they are not entirely empty, by transferring all the cigarettes in said group on to rollers 46 and so forming a gap 26 (FIG. 2) on drum 36.

Alternatively, when no exchange of cigarettes 2 is required between drum 36 and rollers 46, instead of being rotated in time with machines 4, 8 and, hence, successions 22, 25, rollers 46 may either be stopped or rotated at any speed, and accelerated or decelerated for bringing them into time with machines 4 and 8 only when a transfer of cigarettes 2 to and from drum 36 is required. Finally, a controlled-atmosphere environment (not shown) may be created about rollers 46 and cigarettes 2 thereon, for limiting the ventilation effect to which the cigarettes on rollers 46 are subjected pending transfer on to drum 36.

Figure 4:
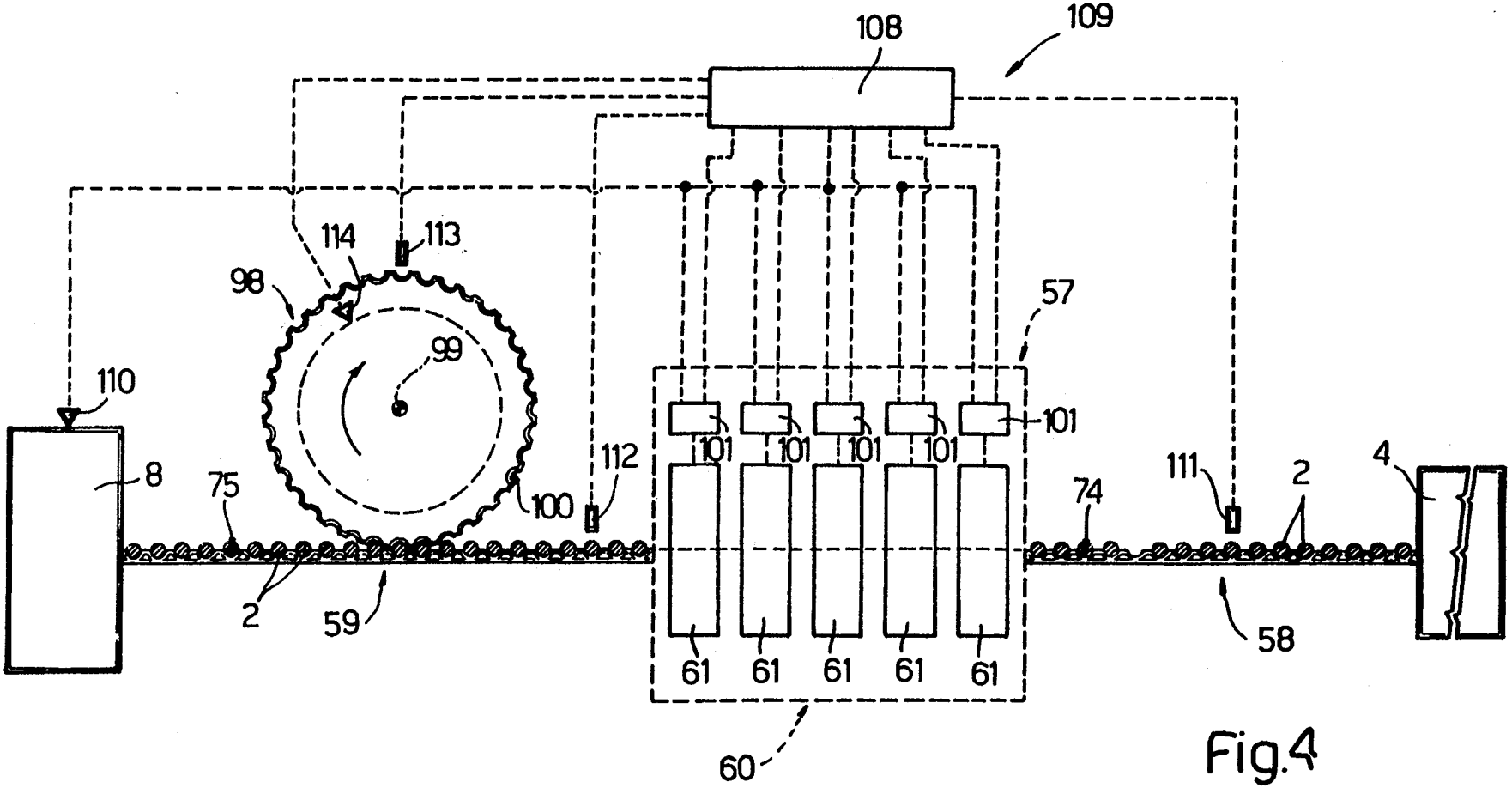
FIG. 4 shows a schematic side view, partly in blocks and with parts removed for clarity, of a second embodiment of a detail in FIG. 2.
Figure 5:
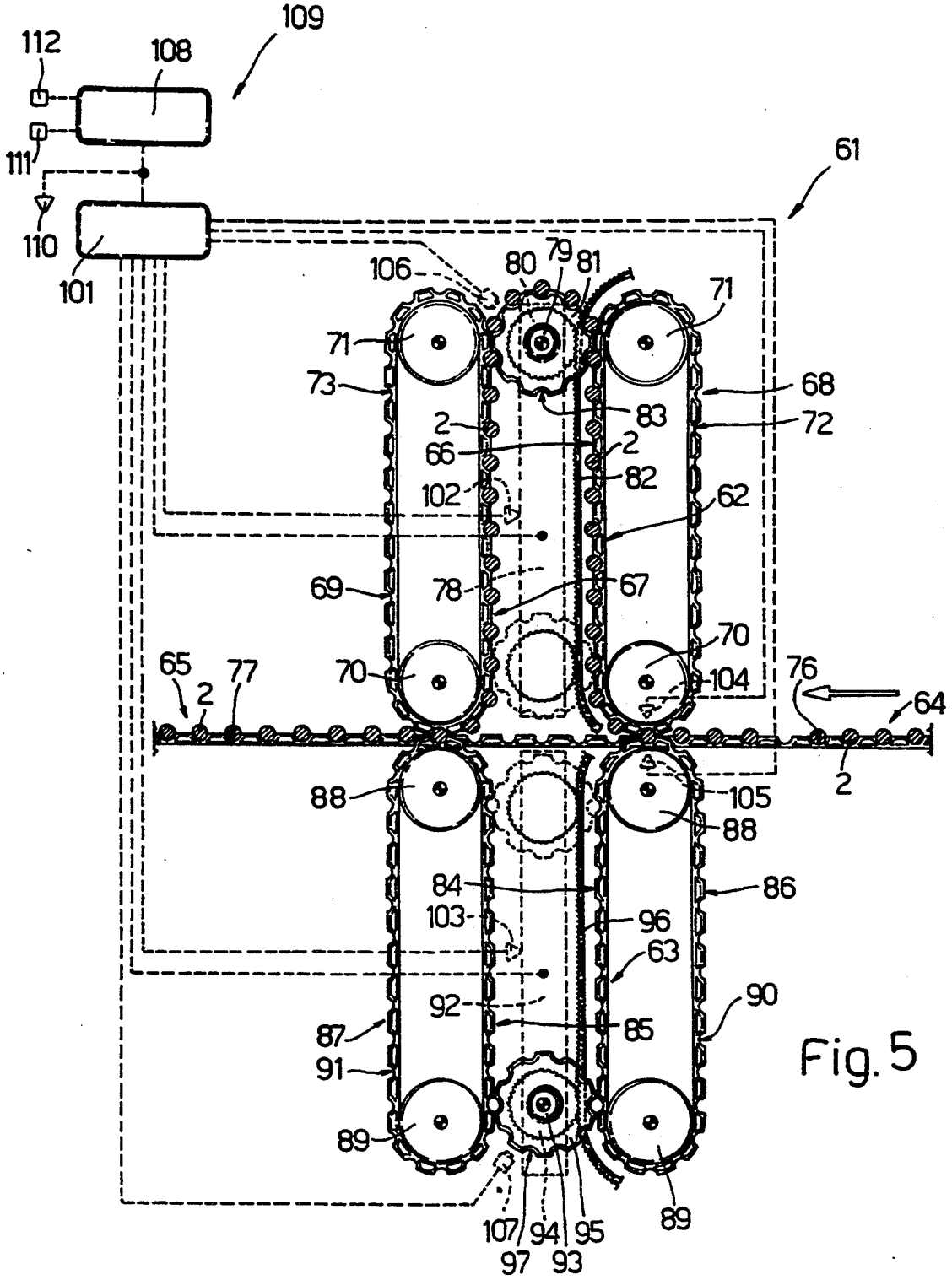
FIG. 5 shows a schematic side view, with parts removed for clarity, of a detail in FIG. 4.

Transfer device 7 as described above may be replaced by a transfer device 57 as shown in FIGS. 4 and 5, and which comprises an output conveyor 58 of machine 4 and an input conveyor 59 of machine 8 connected to each other by a transfer unit 60 comprising a number of series-connected reintegrating devices 61 (or even only one), one of which is shown in detail in FIG. 5.

Each device 61 comprises two conveyor devices 62, 63 defining, for cigarettes 2, respective substantially U-shaped paths with their concavities facing each other. Devices 62, 63 are located on either side of a path for cigarettes 2, defined by an input conveyor 64 and an output conveyor 65 aligned with each other and with conveyors 58, 59, and operating in time with conveyors 58, 59. As shown in FIGS. 4 and 5, conveyors 58, 64, 65 and 59 preferably form a single conveyor extending through unit 60 and rigidly connecting machines 4 and 8.

As shown in FIG. 5, each device 62 comprises two parallel, mutually facing, delivery branches 66, 67 of two endless conveyors 68, 69 looped about respective pairs of pulleys 70, 71, one of which is powered in time with conveyors 58, 59 so as to operate conveyors 68, 69 in the same direction (clockwise in FIG. 5). Conveyors 68, 69 are respectively tangent to conveyors 64, 65, and present respective suction seats 72, 73 for retaining respective cigarettes 2 and equally spaced with the same spacing as similar suction seats 74, 75 on respective conveyors 58, 59, and similar suction seats 76, 77 on respective conveyors 64, 65.

Device 62 also comprises a known, rodless pneumatic cylinder 78 extending between and parallel to branches 66 and 67, and the piston (not shown) of which is fitted with a pin 79 in turn fitted idly with a gear 80 and a roller 81 angularly integral with each other. Gear 80 meshes with an endless toothed belt 82 looped about pulleys (not shown) coaxial with pulleys 70, 71 of conveyor 68, and which travels with conveyor 68 so as to impart to roller 81, via gear 80, a surface speed equal to the traveling speed of conveyor 68. Roller 81 is tangent to branches 66, 67 with which it defines device 62, and presents peripheral suction seats 83 having the same spacing as, and operating in time with, seats 72 and 73.

Device 63 comprises two parallel, mutually facing, delivery branches 84, 85 of two endless conveyors 86, 87 looped about respective pairs of pulleys 88, 89, one of which is powered in time with conveyors 64, 65 so as to operate conveyors 86, 87 in the same direction (anticlockwise in FIG. 5). Conveyors 86 and 87 are respectively tangent to conveyors 64, 68 and conveyors 65, 69, and present respective suction seats 90, 91 for retaining respective cigarettes 2 and equally spaced with the same spacing as seats 72, 73.

Device 63 also comprises a known, rodless pneumatic cylinder 92 extending between and parallel to branches 84 and 85, and the piston (not shown) of which is fitted with a pin 93 in turn fitted idly with a gear 94 and a roller 95 angularly integral with each other. Gear 94 meshes with an endless toothed belt 96 looped about pulleys (not shown) coaxial with pulleys 88, 89 of conveyor 86, so as to impart to roller 95, via gear 94, a surface speed equal to the traveling speed of conveyor 86. Roller 95 is tangent to branches 84, 85 with which it defines device 63, and presents peripheral suction seats 97 having the same spacing as, and operating in time with, seats 90 and 91.

When cylinders 78, 92 are activated, therefore, respective gears 80, 94 roll on respective belts 82, 96, and respective rollers 81, 95 roll on respective branches 66, 84 in time with respective seats 72, 90, so as to vary the number of seats in devices 62, 63 between a minimum and maximum value.

In unit 60 as a whole, said minimum and maximum values differ by a number of seats at least equal to $(n-1)$, where "n" is the number of cigarettes 2 in each packet 9.

Along conveyor 59, downstream from device 57, there is provided a timing roller 98 (theoretically dispensable) tangent to conveyor 59 and rotating about an axis 99, parallel to the axes of pulleys 70, in the same direction as, and at a surface speed equal to the traveling speed of, conveyor 59. Roller 98 presents "n" peripheral suction seats 100 having the same spacing as seats 75 and in time with both seats 75 and machine 8, so that each seat 100 corresponds at all times to a specific cigarette 2 inside the packet 9 formed on machine 8.

As shown in FIG. 5, in each reintegrating device 61, cylinders 78, 92 are feedback-controlled by a control system 101 with sensors 102, 103 for detecting the position of pins 79, 93 and, hence, the instantaneous capacity of devices 62, 63. By means of known distributor elements 104, 105, control system 101 also provides for controlling suction of conveyors 68, 86 at the respective points of tangency with conveyor 64; and is supplied by sensors 106, 107 with signals indicating the presence/absence of cigarettes 2 in respective seats 83, 97 on respective rollers 81, 95 immediately upstream from respective branches 67, 85.

Control systems 101 are also connected to a central unit 108 which, together with control systems 101, sensors 102, 103, 106, 107, and distributor elements 104, 105, forms part of a device 109 for controlling and synchronizing reintegrating devices 61 as a function of signals supplied to central unit 108 and to each control system 101 by a device 110 for detecting the phase of machine 8, and as a function of further signals received from further sensors 111, 112, 113 for detecting and communicating to central unit 108 the presence/absence of cigarettes 2 on conveyors 58, 59 and roller 98 respectively. Central unit 108 also provides for controlling suction through seats 100 on roller 98 by means of a known distributor element 114.

In actual use, in each device 61, devices 62, 63 define, at all times during operation of device 61, two alternative paths: a main path traveled along at that time by cigarettes 2; and a secondary path.

By way of example, operation of device 57 will be described with reference to one device 61, and as of a condition in which respective rollers 81, 95 are positioned halfway along respective cylinders 78, 92, and said main path is defined by device 62, the distributor element 104 of which is active so as to remove the incoming cigarettes 2 by suction off conveyor 64 and feed them along branch 66 of conveyor 68, whereas distributor element 105 is deactivated. In the above condition, the cigarettes 2 supplied by conveyor 64 travel along branch 66 to roller 81 by which they are removed in known manner off branch 66 and transferred successively in known manner to branch 67 and conveyor 65.

In the event sensor 111 detects a vacancy, i.e. an empty seat 74, on conveyor 58, control system 101 determines, via sensor 103, the position of pin 93 and the possibility of pin 93 moving into a reintegrating position corresponding to that occupied at that time by pin 79, but shifted half a step towards device 62, so that the length of the secondary path is one step shorter than that of the main path.

In the event of a positive response, control system 101 activates cylinder 92 so as to move pin 93 into said reintegrating position, and, as soon as the first cigarette 2 following said vacancy reaches the point of tangency between conveyors 68 and 86, deactivates distributor element 104 and activates distributor element 105 so as to feed said first cigarette, and those following it, along the secondary path (now the main path) defined by device 63. As the path defined by device 63 is one step shorter than that defined by device 62, the last cigarette in the succession traveling along device 62 and the first cigarette in the succession traveling along device 63 will be fed, the second immediately behind the first, through the point of tangency between conveyors 69 and 87 so as to form a continuous succession along conveyor 65.

Conversely, i.e. in the event the secondary path through device 63 cannot be shortened one step in relation to the main path through device 62, central unit 108 searches for another device 61 capable of doing so, or, if possible, eliminates the vacancy by lengthening first the secondary paths and then the respective formerly main paths of units 61 by a total number of steps equal to "n−1", so as to bring rollers 81 and 95 into a more central position in relation to respective branches 66, 67 and 84, 85, and so form on conveyor 65 a gap of "n" consecutive seats 77 which may or may not be in time with machine 8. If it is, said gap will be supplied directly to machine 8, which will provide for either performing a no-load cycle or forming an empty packet. If it is not, said gap is timed in relation to machine 8 by roller 98 as described in the following example:

Supposing, for example, that "n" equals twenty, and that said gap consisting of "n" consecutive vacancies is composed, on conveyor 59, of the last fifteen cigarettes of a first packet and the first five cigarettes of a second packet immediately following the first. In this case, distributor element 114 of roller 98, which presents "n" seats 100 and rotates in time with conveyor 59, is so controlled by central unit 108 as to remove the first five cigarettes of the first packet and, after one complete turn, feed them back on to conveyor 59 and into the first five empty seats of the second packet. In this way, the first packet will be empty and the second packet full.

Figure 6:
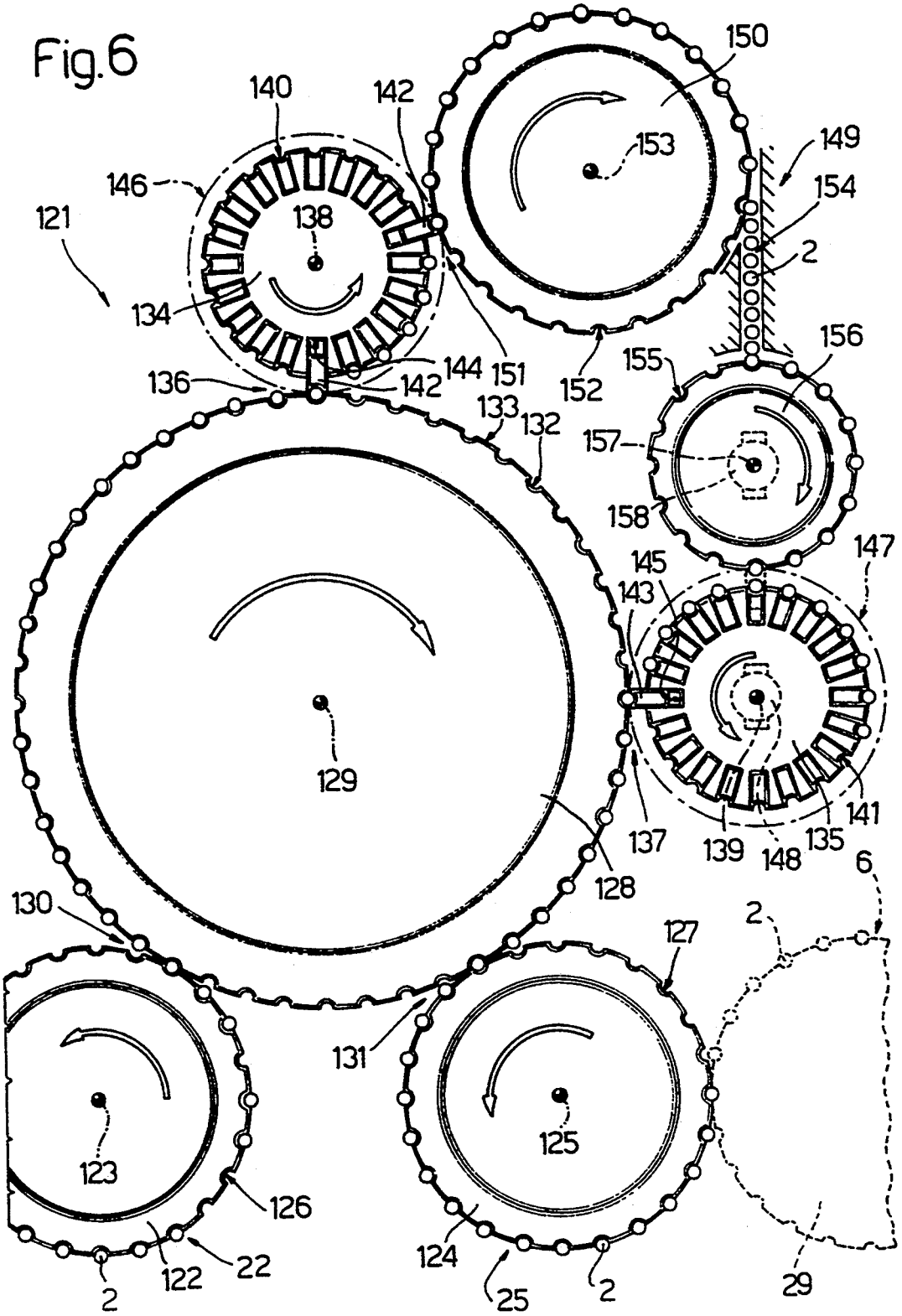
FIG. 6 shows a schematic side view, with parts removed for clarity, of a third embodiment of a detail in FIG. 2.

Transfer device 7 or 57 as described above may be replaced by a device 121 mounted, like device 7, between the output roller 28 (shown in FIG. 3) of filter assembly machine 4 and the input roller 29 of packing machine 8, and comprising an input roller 122 tangent to roller 28 (FIG. 3) and rotating anticlockwise (in FIG. 6) about an axis 123 perpendicular to the FIG. 6 plane; and an output roller 124 tangent to roller 29 and rotating anticlockwise (in FIG. 6) about an axis 125 parallel to axis 123.

Rollers 122, 124 present respective numbers of peripheral suction seats 126, 127 parallel to axes 123, 125 and equally spaced about the periphery of rollers 122, 124 for retaining respective cigarettes 2 by suction.

Device 121 also comprises a powered drum 128 rotating clockwise (in FIG. 6) about an axis 129 parallel to axes 123 and 125, and tangent to roller 122 at a loading station 130 where it is supplied by roller 122 with a discontinuous succession 22 of cigarettes 2. Drum 128 is also tangent to roller 124 at an unloading station 131 where it supplies roller 124 with a succession 25 of cigarettes 2, which is either continuous or at most presents predetermined gaps 26 (FIG. 2) formed by the absence of an "n" number of cigarettes 2 equal to the content of a packet 9 or a whole multiple of said number.

Drum 128 presents a number of peripheral seats 132 equally spaced about the outer surface 133 of drum 128 with the same spacing as seats 126, 127, and each designed to receive and retain in known manner by suction a respective cigarette 2 supplied by roller 122.

Device 121 also comprises a pickup roller 134 substantially tangent to drum 128 at a pickup station 136; and a supply roller 135 substantially tangent to drum 128 at a supply station 137 downstream from station 136 in the traveling direction of cigarettes 2 about the periphery of drum 128. Each of rollers 134, 135 defines a dynamic store for receiving a given number of cigarettes 2, in this case equal to said "n" number of cigarettes 2 in each packet 9, or a multiple of said number. More specifically, rollers 134, 135 rotate anticlockwise (in FIG. 6) about respective axes 138, 139 parallel to axes 123, 125, 129, and present respective suction seats 140, 141 for retaining respective cigarettes 2 by suction.

In particular, seats 140, 141 are movable seats, each formed on a respective slide 142, 143 consisting, in known manner, of the piston of a respective pneumatic cylinder 144, 145 positioned radially along a peripheral annular portion of roller 134, 135. Slides 142, 143 are moved radially in relation to roller 134, 135 by a known pneumatic distributor (not shown) formed inside roller 134, 135 and controlled by a central unit (not shown) similar to unit 43. Said central unit provides for selectively supplying compressed air to cylinders 144, 145, for moving respective slides 142, 143 radially to and from an extracted position wherein respective seats 140, 141 are arranged, with the same spacing as seats 132, about a cylindrical surface 146, 147 tangent to surface 133 at stations 136, 137.

Roller 134 rotates with seats 140 in time with seats 132, while roller 135 is driven by a motor 148 feedback-controlled so as to rotate roller 135 at variable speed ranging between a top speed, at which seats 141 travel in time with seats 132, and a bottom speed for the purpose described later on.

Device 121 also comprises an accumulating store 149, the input end of which is supplied with cigarettes 2 by a transfer roller 150 tangent to cylindrical surface 146 at transfer station 151, and which presents a number of equally spaced peripheral seats 152 with the same spacing as seats 132. Roller 150 rotates about an axis 153, parallel to axis 138, in time with roller 134 and at the same surface speed as seats 140 at cylindrical surface 146.

Store 149 provides for arranging cigarettes 2 in an orderly sequence 154, and for feeding them successively into respective seats 155 formed on the outer periphery of a roller 156 tangent to both the output end of store 149 and cylindrical surface 147. Seats 155 are equally spaced with the same spacing as seats 132, and roller 156 is rotated clockwise (in FIG. 6) about an axis 157 parallel to axis 139 by a motor 158 feedback-controlled so as to impart to roller 156 a surface speed equal to said bottom surface speed of roller 135, and in time with seats 141 of roller 135 rotating at said bottom speed.

Device 121 presents a control device (not shown) similar to device 109, and which picks up a phase signal from machine 8 for dividing the seats 132 traveling through station 136 into groups of "n" consecutive seats, each of which groups is designed to receive the cigarettes 2 from which to form a packet 9 on machine 8.

In actual use, when device 121 is started up, seats 140 on roller 134 rotating in time with drum 128 are all empty. As one or more empty seats 132 approach station 136, slides 142 are all extracted successively, and the suction system (not shown) through seats 140 is activated so as to remove from drum 128 the entire group of cigarettes 2 presenting said empty seats, and so form on drum 128, downstream from station 136, a gap corresponding in number and location of the vacancies to a given packet.

After removing the respective cigarette 2 in said group at station 136, each slide 142 is withdrawn, and roller 134, still retaining the removed cigarettes 2, continues rotating in time with drum 128. Upon the arrival of further empty seats 132 in station 136, the control system (not shown) determines whether each empty seat 132 travels through station 136 simultaneously with a full seat 140.

In the event of a positive response, respective slide 142 is extracted so as to transfer the respective cigarette 2 into the corresponding empty seat 132. In other words, roller 134 is used, when possible, for reintegrating any vacancies corresponding purely randomly with a full seat 140 at station 136.

In the event of a negative response, on the other hand, roller 134 is emptied entirely by transferring any cigarettes 2 into respective seats 152 on roller 150, and again provides for removing a further incomplete group of cigarettes 2 supplied by drum 128 to station 136, thus forming a gap corresponding to a whole packet 9 on drum 128 downstream from station 136. At the same time, the cigarettes 2 in seats 152 are fed by roller 150 to store 149 where they accumulate into said orderly succession 154 resting on the periphery of roller 156. When, by means of a sensor (not shown), succession 154 is found to be composed of a given (e.g. "n") number of cigarettes 2, the control device (not shown) activates motors 158 and 148 at low speed to enable roller 156 to successively remove cigarettes 2 from store 149 and feed them successively into seats 141 traveling about axis 139 in time with seats 155 on roller 156. Cigarettes 2 in seats 155 on roller 156 are transferred to seats 141 on roller 135 by successively moving slides 143 to and from the extracted position.

Once seats 141 are all filled, motor 148 is accelerated to bring seats 141 into time with seats 132 at station 137, and so enable reintegration, at station 137 and on the periphery of drum 128, of a whole gap formed previously by roller 134 removing an entire incomplete group at station 136.

We claim:

1. A method of manufacturing products (2), particularly tobacco items, on a production line (1), particularly a line (1) for producing and processing cigarettes; the line (1) comprising at least a first product manufacturing machine (4), and at least a second product grouping machine (8); and the method comprising stages wherein, by means of said first machine (4), a first succession (22) is formed possibly presenting randomly distributed vacancies (24), each defined by at least one missing said product (2); and, via transfer means (A) for connecting said two machines (4, 8) rigidly and in time with each other, said first succession (22) is fed to said second machine (8) for forming the products (2) into groups (G), each comprising a given number (n) of products (2); characterized by the fact that it comprises a further stage wherein, via said transfer means (A), said first succession (22) is manipulated and converted into a second succession (25) for supply to said second machine (8) and comprising a succession of gaps (26) and full portions (27), in which each said gap (26) and each said full portion (27) is composed of a number of products which is a multiple of said given number (n) and in time with said second machine (8).

2. A method as claimed in claim 1, characterized by the fact that the first succession (22) is manipulated by the addition of integrating products (2) with which to fill all said vacancies (24).

3. A method as claimed in claim 2, characterized by the fact that said integrating products (2) are withdrawn from storage means (46)(134); at least some of said gaps (26) being formed for reloading said storage means (46)(134).

4. A method as claimed in claim 1, characterized by the fact that the first succession (22) is manipulated by varying the length of the path along which said first succession (22) travels through said transfer means (A) so as to eliminate said vacancies (24).

5. A method as claimed in claim 4, characterized by the fact that the length of said path is varied by switching said products (2), inside said transfer means (A), between a main path and an alternative path parallel to and shorter in length than said main path; said alternative path containing at least one product (2) less than said main path, for eliminating a corresponding said vacancy (24).

6. A method as claimed in claim 4, characterized by the fact that the length of said path is varied by switching said products (2), inside said transfer means (A), between a main path and an alternative path parallel to said main path, and by lengthening said two paths by a total length such as to eliminate at least one said vacancy (24) by forming a said gap (26).

7. A method as claimed in claim 1, characterized by the fact that the first succession (22) is manipulated by removing products (2) from the first succession (22) so as to replace said vacancies (24) with a succession of said gaps (26).

8. A method as claimed in claim 7, characterized by the fact that it comprises further stages wherein said removed products (2) are formed into orderly groups containing said given number (n) of products (2); and said orderly groups are fed into said second succession (25) for integrating respective said gaps (26).

* * * * *